US005115794A

United States Patent [19]

Moormann

[11] Patent Number: 5,115,794

[45] Date of Patent: * May 26, 1992

[54] COMPRESSIBLE BALL LAUNCHER

[75] Inventor: Randall H. Moormann, Georgetown, Mass.

[73] Assignee: Tonka Corporation, Minnetonka, Minn.

[ * ] Notice: The portion of the term of this patent subsequent to Jan. 9, 2007 has been disclaimed.

[21] Appl. No.: 433,571

[22] Filed: Nov. 7, 1989

Related U.S. Application Data

[63] Continuation of Ser. No. 269,255, Nov. 9, 1988, Pat. No. 4,892,081.

[51] Int. Cl.[5] ..... F41B 11/00

[52] U.S. Cl. ..... 124/65; 124/83

[58] Field of Search ..... 124/65, 66, 64, 63, 124/60, 56, 37, 83

[56] References Cited

U.S. PATENT DOCUMENTS

| | | | |
|---|---|---|---|
| 1,171,197 | 2/1916 | Harmon, Jr. | 124/65 |
| 1,559,789 | 11/1925 | Schmidt et al. . | |
| 2,630,108 | 3/1953 | White | 124/65 |
| 2,749,902 | 6/1956 | Foster | 124/65 |
| 2,762,356 | 9/1956 | Foster | 124/65 |
| 3,080,859 | 3/1963 | Benkoe | 124/64 |
| 3,236,521 | 2/1966 | Knott | 124/64 X |
| 3,765,396 | 10/1973 | Kienholz et al. | 124/65 |
| 4,892,081 | 1/1990 | Moormann . | |

FOREIGN PATENT DOCUMENTS

| | | |
|---|---|---|
| 0367905 | 5/1990 | European Pat. Off. . |
| 2648036 | 4/1978 | Fed. Rep. of Germany . |
| 1017630 | 5/1950 | France . |
| 998710 | 1/1952 | France . |

*Primary Examiner*—Peter M. Cuomo
*Attorney, Agent, or Firm*—Donald Brown

[57] ABSTRACT

A launcher for a soft compressible closed cell foam ball which includes a cavity in which the ball is forced into from the front of the barrel and is held loosely therein and a plunger coupled to the barrel for causing theball to be compressed and then spring out of the cavity accompanied by a loud popping sound.

1 Claim, 2 Drawing Sheets

COMPRESSIBLE BALL LAUNCHER

This application is a continuation of Ser. No. 07/269,255, filed on Nov. 9, 1988, now U.S. Pat. No. 4,892,081.

BACKGROUND OF THE INVENTION

This invention is directed to a new and improved toy device for launching a compressible foam ball.

In the past, many different toy constructions for launching balls were proposed e.g. see U.S. Pat. Nos. 1,171,197; 2,725,869; 2,853,991; 3,120,387; 3,236,521; 3,301,246; 3,744,472 and 3,765,396.

The present invention is an improvement over such prior art based on its simple construction as well as the manner in which it functions to propell a soft compressible closed cell foam ball from the forward section of the lanucher.

BRIEF DESCRIPTION OF THE INVENTION

The present invention is directed to a structure having a barrel which a person is able to hold in one hand and a slide plunger with a handle, which a person is able to hold in the other hand to move the plunger in the barrel to launch the compressible foam material closed cell ball positioned in the ball holder cavity of the barrel. To load the launcher, the ball is first squeezed past the front edge of the mouth of the barrel and is positioned in a ball holder cavity at the front of the barrel. The plunger is then retracted, which draws the ball reward against the reward narrow portion of the ball holder cavity and causes air to be sucked into the barrel between the ball and the front end of the plunger. Thereafter the user quickly moves the plunger forward in the barrel to cause trapped air to be compressed thus forcing the ball to squeeze past the front rigid edge portion of the ball holder cavity. As the ball squeezes by the front constriction, it is launched with a spring like action from the mouth of the barrel accompanied by a loud popping sound. In this invention, compressed air rather than direct plunger contact, is used to shoot the ball out of the launcher.

DETAILED DESCRIPTION OF THE INVENTION

Figure 1:
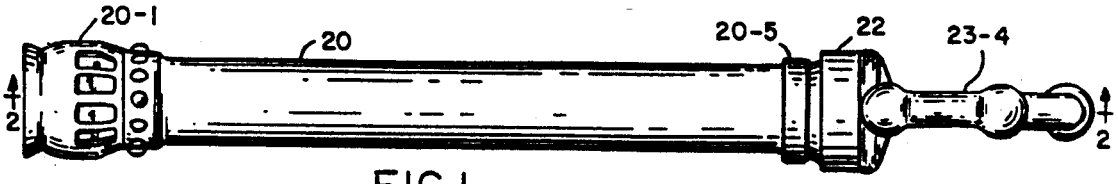
FIG. 1 is a top plan view of the launcher o this invention.
Figure 2:
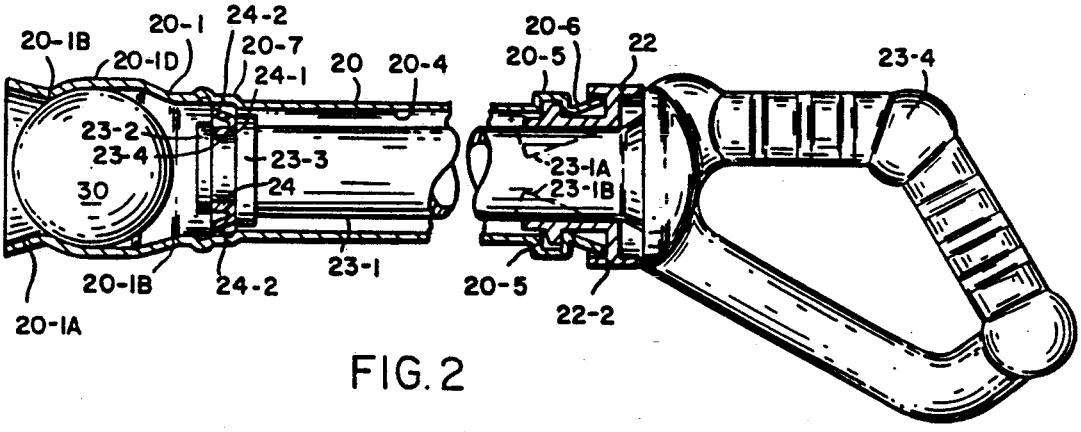
FIG. 2 is a sectional view taken along line 2—2 of FIG. 1 with the plunger in its recessed position.
Figure 3:
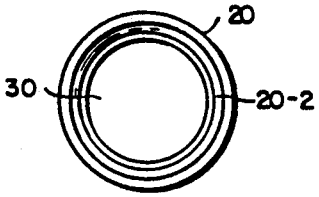
FIG. 3 is a front view of the launcher showing the front of the barrel with the ball positioned therein and not showing the handle portion at the rear.

Reference should first be had to FIGS. 1 to 4 for a description of the invention. At 20, there is shown a barrel having a front end ball retaining portion 20-1. The portion 20-1 has a flared out portion 20-1A, a inward projecting constriction 20-1B for preventing a compressible foam ball from rolling out of the front of the launcher once placed in the ball retaining portion 20-1D as shown in FIG. 2.

Figure 5:
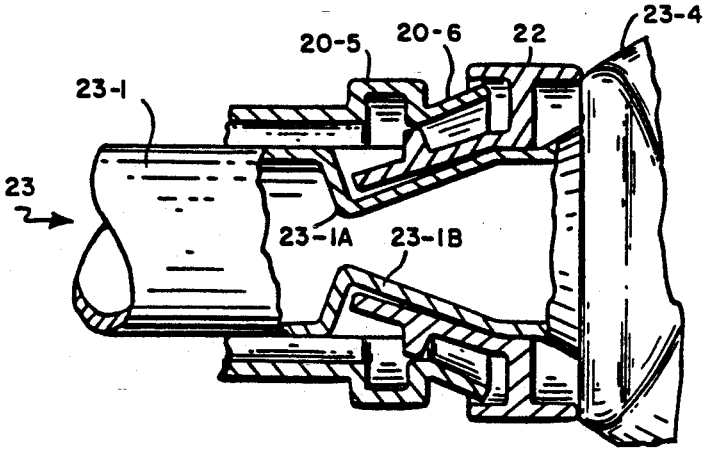
FIG. 5 is a side plan view partially in section of the collar and plunger portions used for assembly of the launcher.
Figure 6:
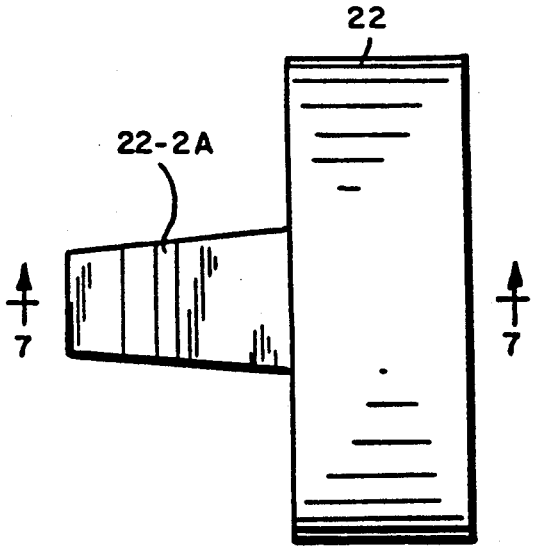
FIG. 6 is a top view of the collar of the launcher.
Figure 7:
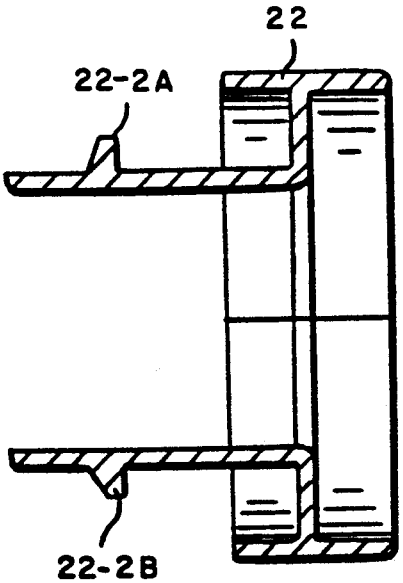
FIG. 7 is a partial sectional view of the collar taken along line 7—7 of FIG. 6.
Figure 8:
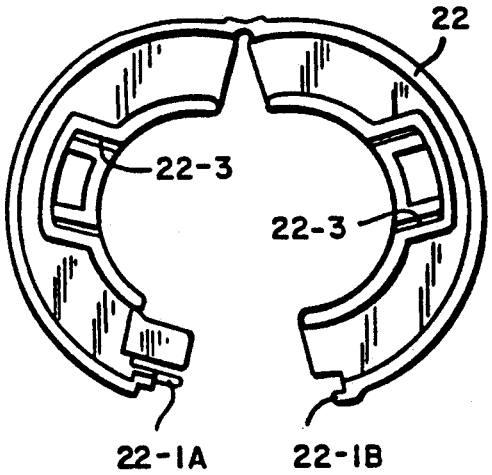
FIG. 8 is an end view of the collar from the right side of FIG. 6.
Figure 9:
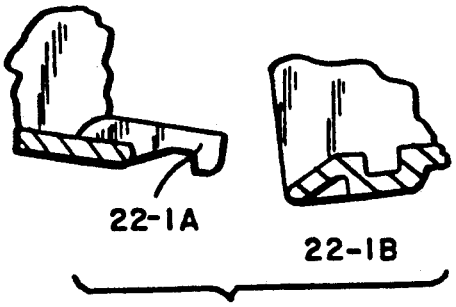
FIGS. 9 and 10 show in section the structure for holding the collar about the barrel.
Figure 10:
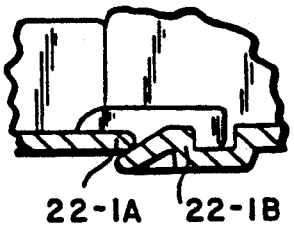

Positioned to the rear of the constriction 20-1B, is a narrowed down portion 20-1C, which prevents the ball 30 from entering the main section of the barrel when the plunger 23 is partially pulled out of barrel 20. The ball 30, after being pushed beyond the ring 20-1B, enters a ball holding portion (cavity) 20-1D, which is preferably slightly larger than the diameter of the ball, so that the ball can preferably move back and forth when the plunger 23 is partially withdrawn from the barrel 20 to suck air into the barrel and to stay in its relaxed (original shape), so that it doesn't take a set. The plunger 23 comprises a central shaft portion 23-1, with first and second projecting rings 23-2 and 23-3 to form a channel 23-4 therebetween for the seating of an annualar air seal 24. The seal is of elastomer plastic 24 and has a portion 24-1, which seats in the bottom of the channel 23-4 between the rings and a spring like sealing portion 24-2, which slides against the interior 20-4 of the barrel 20. When the plunger 23 is in its most forward position, as shown in FIG. 2, the seal extends slightly beyond the barrel step 20-7. The plunger when pulled to the rear (right of FIG. 2) to draw air into the barrel i.e. between the ball 30 and the front 23-2 of the plunger 23, the spring like seal portion 24-2 takes the shape shown in FIG. 4. To facilitate the simple assembly of the ball launcher, there is provided a collar 22 (See FIGS. 5 to 10) which is formed in two connected halves (See FIG. 8) and is provided with a two part latch assembly 22-1A and 22-B to couple the two opposite ends together. The collar has two spring like detents 22-2A and 22-2B, which snap into a cannular channel 20-5 formed in the barrel. The plunger section 23-1 is provided with two slots 23-1A and 23-1B for temporarily depressing the two detents 22-2A and 22-2B downwardly until they are in position to snap into the channel 20-5 to assemble the launcher. FIGS. 5 and 6 show the collar 22, with the spring like detents 22-2A and 22-2B, which fit into the channel 20-5.

In operation, a person holds the barrel 20 in one hand and forces the soft compressible ball 30 past constriction 20-1B into the ball retaining region 20-1D with the other hand.

Thereafter the person pulls the handle 23-4 to the right of FIG. 2 while holding the barrel 20 in the other hand. This causes the ball 30 to move towards the constriction 20-1C and as air flows into the interior of the barrel 20 between the ball 30 and the withdrawn end of the plunger. The ball ultimately seats against the constriction 20-1C.

Figure 4:
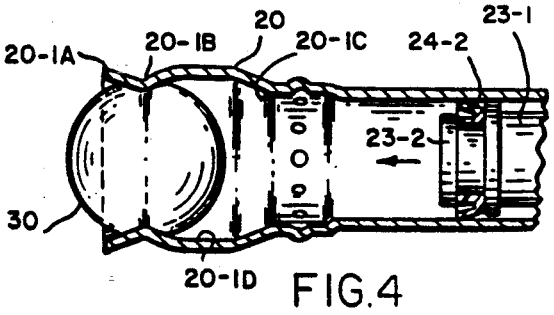
FIG. 4 is a sectional view similar to FIG. 2 with the plunger being moved forward to compress the ball so the ball can squeeze past the rigid constriction at the front of the ball holder portion.

The handle 23-4 is then forced quickly forward (to the left of FIG. 4) as shown by the arrow to cause the air between the ball and the plunger end 23-2 to compress thus causing the ball 30 to compress and distort as shown in FIG. 4 as it passes by the constriction 20-1B. Thus, the ball 30 acts to seal off the front constriction 20-1B until it is launched. Air is vented to the rear of the plunger portion 23-3 and seal 24 through vents 22-3 in the collar.

As the ball passes by the constriction 20-1B, the ball 30 springs and pops out of the front end of the barrel with a loud popping sound. A person can also move the plunger in a back and forth motion to cause the ball 30 to move back in the cavity 20-1D and produce a popping sound. The cavity 20-1D also being wider in diameter than the ball 30, prevents the plasitic of the ball from taking a permanent set and thus losing its round shape.

The ball 30 is preferably of a multicellular closed cell foamed material such as polyethylene or the like and is able to compress at last 5% and preferably at last 10% to 25% of its diameter and then spring back to its initial shape so that the ball appears to explode out of the barrel. About 10% ball diameter compression appears to be quite satisfactory. The ball launcher device of this invention is preferably constructed of plastic such as polyethylene or the like. The front seal is preferably made of an elastomer e.g. PVC or natural rubber.

I claim:

1. A ball launcher system comprising a barrel, a plunger positioned in the barrel for slideable motion therein, said plunger forms a seal between it and the inner diameter of the barrel, a compressible foam ball which will spring back substantially to its original shape after compression, the front portion of the barrel having a cavity for receiving said ball, said cavity having rigid constriction at the front thereof, said ball positioned in said cavity, said constriction having an internal diameter less than the external diameter of the ball, and said constriction having an internal diameter less than the largest inner diameter of the cavity to the rear thereof, a portion of said ball receiving cavity to the rear of said constriction also being larger in diameter than that diameter of said ball and a rear constriction in the barrel so that the ball can only be loaded into the cavity from the front open end of said barrel, and said plunger when moved towards said cavity first causes said ball positioned therein to be compressed against the rigid constriction and then causes said ball to move by said rigid constriction as it continues to be compress and then be expelled from said cavity.

* * * * *